US005722589A

United States Patent [19]

Richards

[11] Patent Number: 5,722,589

[45] Date of Patent: Mar. 3, 1998

[54] COMPOSITE LOAD BEARING STRUCTURE

[75] Inventor: Denis C. Richards, Mississauga, Canada

[73] Assignee: Green Track Inc., Bolton, Canada

[21] Appl. No.: 814,643

[22] Filed: Mar. 10, 1997

Related U.S. Application Data

[63] Continuation-in-part of Ser. No. 368,903, Jan. 5, 1995, Pat. No. 5,609,295.

[51] Int. Cl.[6] ..... E01B 3/36

[52] U.S. Cl. ..... 238/84; 238/85; 238/106

[58] Field of Search ..... 238/84, 85, 106, 238/346.01; 106/714, 738, 817; 492/17

[56] References Cited

U.S. PATENT DOCUMENTS

| | | | |
|---|---|---|---|
| 1,616,266 | 2/1927 | Lacey | 238/106 |
| 3,813,040 | 5/1974 | Heinemeyer | 238/84 |
| 4,150,790 | 4/1979 | Potter | 238/85 |
| 5,104,039 | 4/1992 | Oestmann | 238/106 |
| 5,367,007 | 11/1994 | Richards | 524/59 |
| 5,609,295 | 3/1997 | Richards | 238/84 |

*Primary Examiner*—S. Joseph Morano
*Attorney, Agent, or Firm*—Donald E. Hewson

[57] ABSTRACT

A composite load bearing structure comprises a main body portion having a top surface and a bottom surface defining a dimension of thickness therebetween, first and second side surfaces defining a dimension of width therebetween, first and second end surfaces defining a dimension of length therebetween, and a first longitudinal axis oriented along the length of the main body portion. The thickness is significantly less than at least the length of the load bearing structure. The main body portion is made of a first composite material comprising a binding constituent in a proportion of about 10% to about 20% by volume, and an aggregate material in a proportion of about 80% to about 90% by volume. The binding constituent comprises polyethylene or a polyethylene blend having at least 10% polyethylene. The aggregate material is in the form of irregular multi-faceted pieces of crushed furnace slag, crushed gravel, crushed limestone, crushed granite, crushed basalt, crushed trap rock, and mixtures thereof, and the pieces of aggregate material are distributed and otherwise arranged within the main body portion so that opposed surfaces of the pieces of aggregate material have at least partial contact, one with another, in a contiguous manner. An inner strengthening member is disposed within the main body, and may comprise reinforcing bars; rolled, drawn, or cast ferrous sections; rolled, drawn, or cast composite alloy sections; plastic, metallic, and carbon based fibers; wire mesh, and expanded metal mesh.

23 Claims, 4 Drawing Sheets

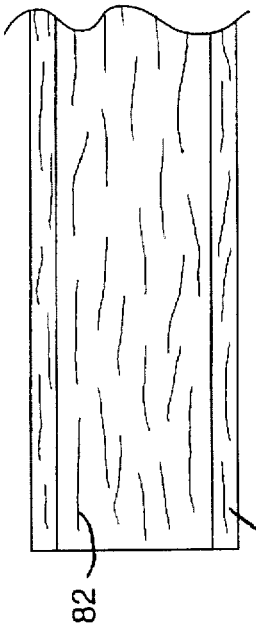
FIGURE 8
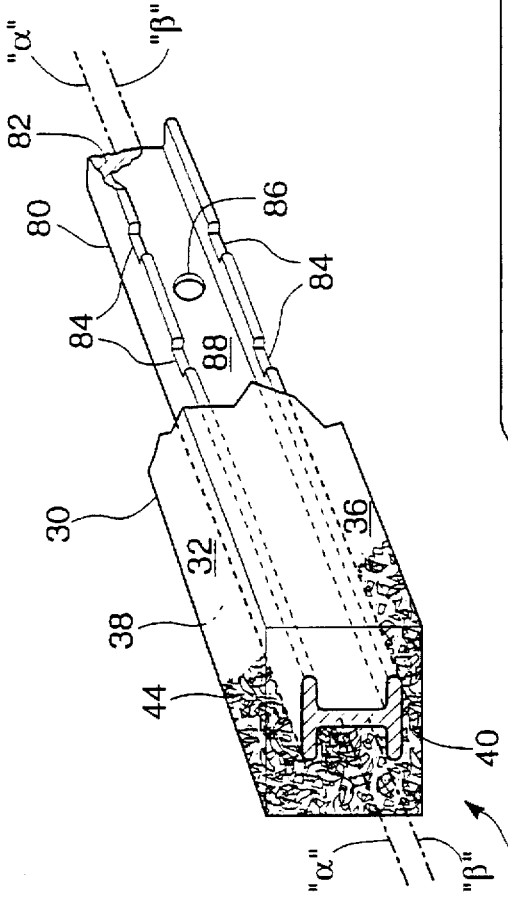
FIGURE 2
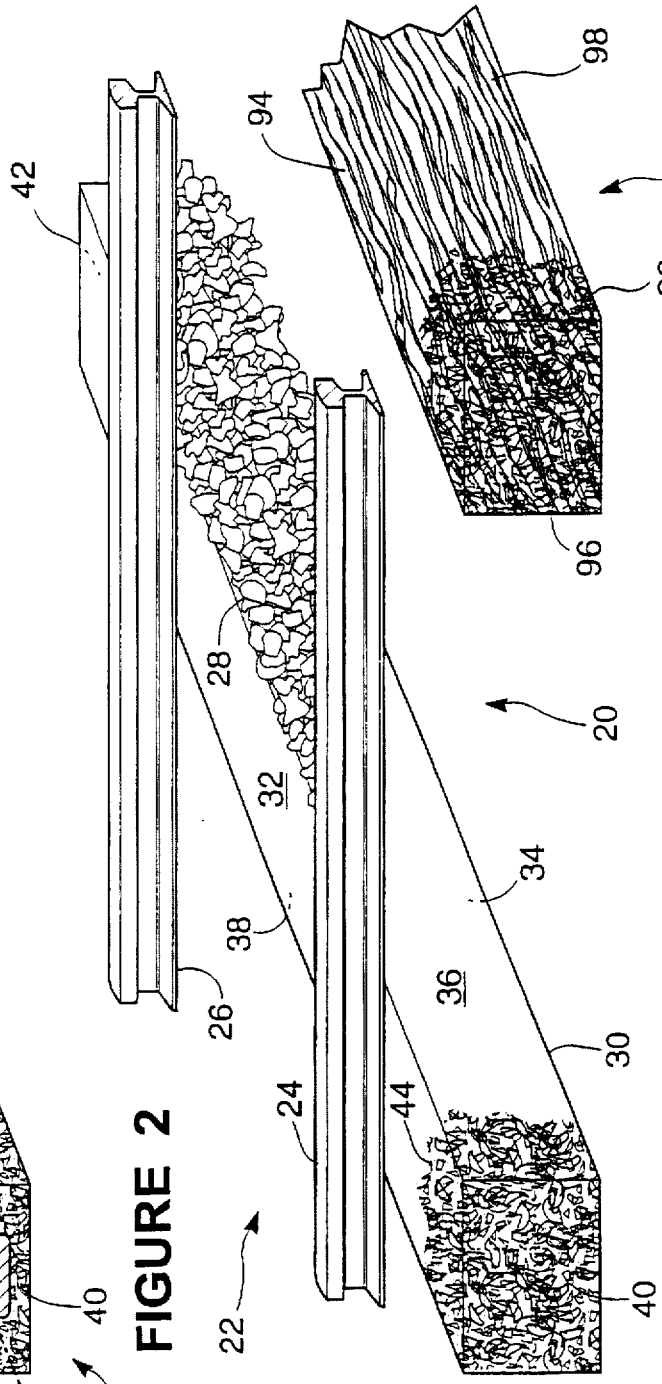
FIGURE 1
FIGURE 9

COMPOSITE LOAD BEARING STRUCTURE

CROSS REFERENCE

This application is a Continuation-In-Part of application Ser. No. 08/368,903 filed Jan. 5, 1995, which application issued on Mar. 11, 1997, as U.S. Pat. No. 5,609,295.

FIELD OF THE INVENTION

This invention relates to railway ties, more specifically composite railway ties, and a process for forming such railway ties. This invention relates to composite load bearing structures and more particularly to composite load bearing structures having inner strengthening members.

BACKGROUND OF THE INVENTION

In modern times, it is important, for economic and environmental considerations, to make products from recycled or reusable materials where possible. One source of recycled material is that of polyethylene from recycled "curbside" plastic. Recycling programs in many areas have made recycled polyethylene very abundant and relatively inexpensive. Many presently manufactured products make use of recycled material such as recycled polyethylene.

In contrast to the present trend to include recycled materials in products, the construction of conventional composite load bearing structures, such as buildings, roads, parking lots, retaining walls, railroad beds, highway traffic barriers, and so on, typically uses virgin materials. This is for two reasons. Firstly, there is not a great abundance of recycled or reused material that is suitable for use in the formation of such load bearing structures. Secondly, and more importantly, since there is only a limited supply of recycled or reusable or materials for such use, and which supply has only been available for perhaps a few years, there has never been incentive to develop composite load bearing structures using recycled material—almost exclusively, composite load bearing structures are made from virgin materials.

For instance, railroad ties are typically made from either wood, steel, or concrete. Wood railway ties are preferred in North American, since they can stand severe climatic change, and are relatively low cost to purchase and initially install, at least compared to other types of railway ties.

Such conventional wood railway ties have several disadvantages associated with them. Firstly, they are obtained by cutting down trees, which is generally considered environmentally undesirable. Considering the number of miles of railway lines there are in North America, for instance, a staggering number of wood railway ties must be used each year. Indeed, recent statistics indicate that twelve million wood railway ties were installed in North America in 1993, which number appears typical of the past few years. These twelve million wood ties were taken from hardwood trees such as oak and hard maple. An average of only three eight-foot long ties are available from a mature hardwood tree. Accordingly, over a five year period, for instance, about 20 million hardwood trees would need to be cut down to serve the railroad industry in North America alone. If this number is translated to use throughout the world, the number of trees that must be cut down over a five year period could be in the order of 100 million, which is an unacceptably high number and certainly has a severe impact on the environment. In these days of environmental consciousness, it is highly undesirable to continue to use wood ties.

Further, wood ties need to be replaced every few years, and thus tend to be somewhat expensive over a long period of time. The typical service life of a wood railway tie on a North American railway line is about ten years before the railway tie must be removed and replaced with a new tie. Considering the number of railway ties replaced in North America each year, and considering all developed countries in the world where railway ties are used, and therefore replaced, the number of railway ties replaced per year is absolutely staggering, thus leading to higher long term costs.

In use, wood railway ties are supported and somewhat surrounded by a compacted granular bed known as ballast. The ties tend to shift in the ballast bed, due to the extreme dynamic loading on the railroad track by a passing train. Wood railway ties therefore require routine maintenance in order to ensure that they are properly supporting the railway track rails. Also, the ballast bed requires consistent and regular maintenance in order to keep the individual pieces of ballast in place.

The preservatives that are used to treat wood railway ties in order to protect the wood railway ties from insects, rotting, and so on, are used are typically made from hazardous chemicals, such as creosote, which is a known carcinogen. It is therefore undesirable to manufacture such railway ties, to have such railway ties in the environment during use, and also generally unacceptable to dispose of old used railway ties because of the impact on the environment.

Concrete railway ties are popular in Europe and Japan, and in other places in the world, where the availability of hardwood is limited. Concrete railway ties do have problems associated with them, however. Firstly, they are relatively expensive and can crack or spall over a number of years when used in areas of dramatic climatic change. Most significantly, they can suffer from rail to tie erosion under the heavier rolling stock loads in North America as compared to the lighter and smaller locomotives and passenger and freight cars used in Europe.

Steel railway ties realize only limited use in North America and other parts of the world. Susceptibility to rust and a high noise level during use, which is unacceptable on passenger trains, limits their acceptability. Moreover, in places where the steel railway rails are also used to send electrical signals along the railroad right-of-way, and must therefore be electrically isolated one from the other, the use of electrically conductive railway ties between the rails is precluded.

It can be seen that there are many disadvantages to present railway ties, including economic and environmental disadvantages. In spite of this, wood, concrete, and steel railway ties continue to be state-of-the-art.

Another example of composite load bearing structures wherein virgin materials are used are patio stones, which are made from various types of stone or other particulate aggregate such as gravel, or possibly decorative types of stone, held together by cement. The cement is made from sand and a binding mortar typically including clay or shale, which is a source of aluminum silicate, and chalk or limestone, which is a source of calcium carbonate, which are all virgin materials. Other composite load bearing structures that are made from aggregate held together by cement or some sort of similar binding material including highway traffic barriers, pre-formed curbs for parking lots, sound barriers, and retaining wall members. Such composite load bearing structures typically also contain metal strengthening members, such as reinforcing bar, to provide sufficient structural strength. For all of these named composite load bearing structures, and others, virgin materials are used almost exclusively in their construction, which is unduly expensive and is environmentally disadvantageous. Also, the use of virgin materials, such as wood, stones and other rock, sand, gravel, clay or shale, and chalk or limestone, ultimately has a negative environmental impact, as they are removed from the environment, and generally not replaced, except for wood which may be replaced very slowly by nature itself.

Further, these composite load bearing structures are all subject to wear and deterioration, and must be replaced, some more frequently than others. Such replacement, especially if it is frequent, is undesirable, both in terms of expense of materials and labour, and in terms of inconvenience. Moreover, the worn or deteriorated composite load bearing structures tend to be unsightly.

One reason for wear and deterioration of such composite load bearing structures is that they are commonly water permeable to a substantial degree, and therefore, especially in geographical areas having cold winter climates, they are affected by penetration of moisture if the moisture subsequently freezes, thus stressing and possibly cracking portions of the composite load bearing structure.

It is an object of the present invention to provide an improved composite load bearing structure that can be produced and used with little or no negative environmental impact.

It is another object of the present invention to provide an improved composite load bearing structure that lasts significantly longer than other similar structures.

It is yet another object of the present invention to provide an improved composite load bearing structure that costs less in terms of continuing maintenance.

It is still another object of the present invention to provide an improved composite load bearing structure that will not crack in cold weather.

It is another object of the present invention to provide an improved railway ties that lasts significantly longer than conventional wood railway ties.

It is a further object of the present invention to provide an improved railway tie that is suitable for use in virtually all types of railway lines.

It is yet a further object of the present invention to provide an improved railway tie that absorbs the noise of a train passing thereover.

SUMMARY OF THE INVENTION

In accordance with one aspect of the present invention, there is provided a composite load bearing structure comprising a main body portion having a top surface and a bottom surface defining a dimension of thickness therebetween, first and second side surfaces defining a dimension of width therebetween, first and second end surfaces defining a dimension of length therebetween, and a first longitudinal axis oriented along the length of the main body portion. The dimension of thickness is significantly less than at least the length of the load bearing structure. The main body portion is made of a first composite material comprising a binding constituent in a proportion of about 10% to about 20% by volume, and an aggregate material in a proportion of about 80% to about 90% by volume. The binding constituent in the main body portion comprises a plastic material chosen from the group consisting of polyethylene and a polyethylene blend having at least 10% polyethylene. The aggregate material is in the form of irregular multi-faceted pieces chosen from the group consisting of crushed furnace slag, crushed gravel, crushed limestone, crushed granite, crushed basalt, crushed trap rock, and mixtures thereof, and pieces of the aggregate material are distributed and otherwise arranged within the main body portion so that opposed surfaces of the pieces of aggregate material have at least partial contact, one with another, in a contiguous manner. There is at least one inner strengthening member having a second longitudinal axis which is substantially parallel to the first longitudinal axis, which at least one inner strengthening member is chosen from the group consisting of reinforcing bars; rolled, drawn, or cast ferrous sections; rolled, drawn, or cast composite alloy sections; plastic, metallic, and carbon based fibers; wire mesh, and expanded metal mesh.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which:

FIG. 1 is a perspective view of one embodiment of the composite load bearing structure according to the present invention, specifically a railway tie, installed in a railway track;

FIG. 2 is a perspective partially cut-away view of a portion of the composite load bearing structure of FIG. 1;

FIG. 8 is a side elevational view of a portion of an alternative embodiment of an inner strengthening member of the composite load bearing structure according to the present invention; and FIG. 9 is a perspective view of a portion of an alternative embodiment of the composite load bearing structure according to the present invention.

DETAILED DESCRIPTION OF THE PREFERRED EMBODIMENTS

Figures 3A, 3B, 3C:
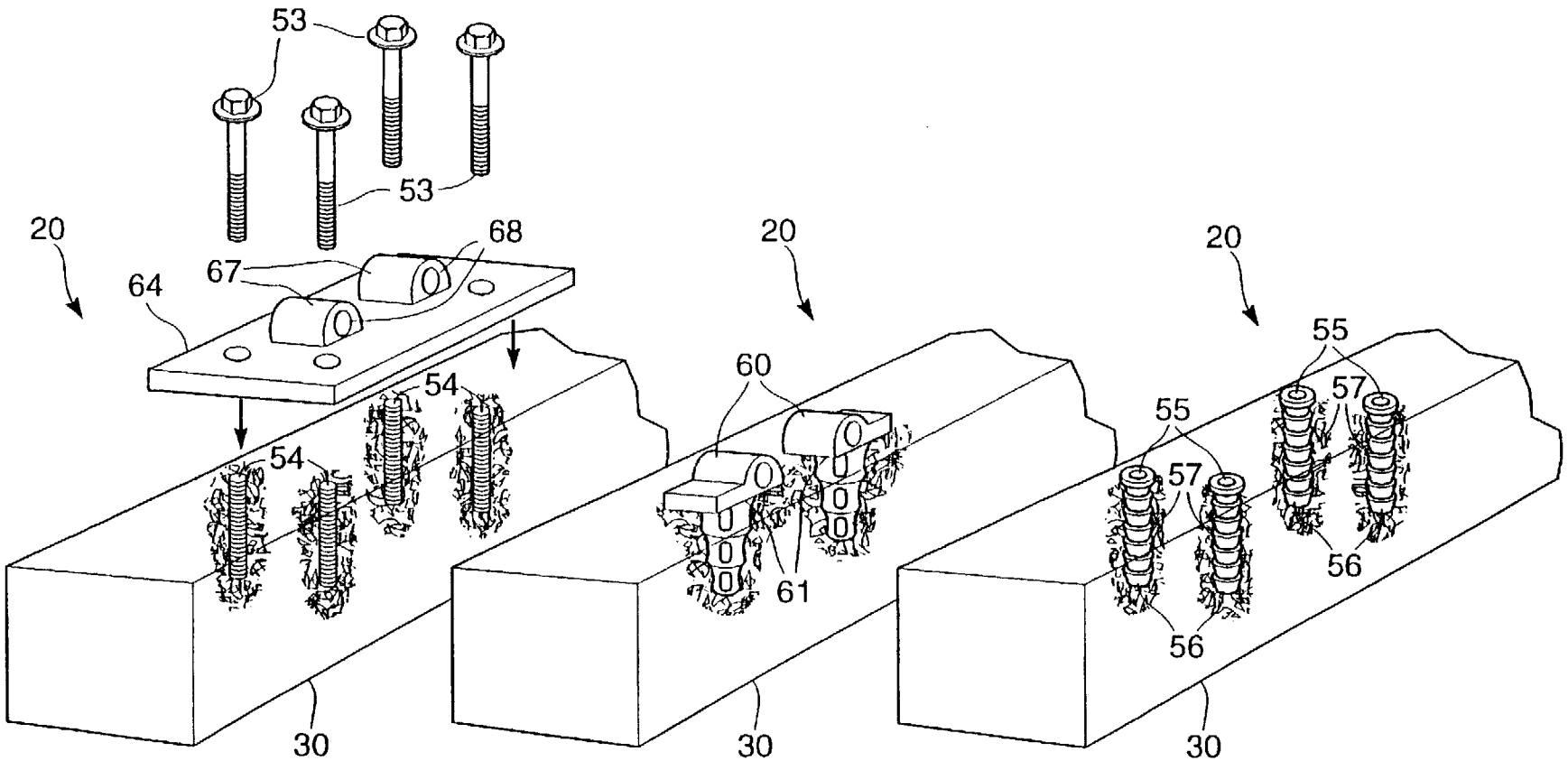
FIG. 3A is a perspective view of an end portion of the railway tie of FIG. 1, additionally showing four fastener receiving apertures.
FIG. 3B is a perspective view of an end portion of the railway tie of FIG. 1, additionally showing two fastener receiving element retained within two co-operating fastener receiving apertures.
FIG. 3C is a perspective view of an end portion of the railway tie of FIG. 1, additionally showing four fastener receiving elements retained within four co-operating fastener receiving apertures.
Figure 4:
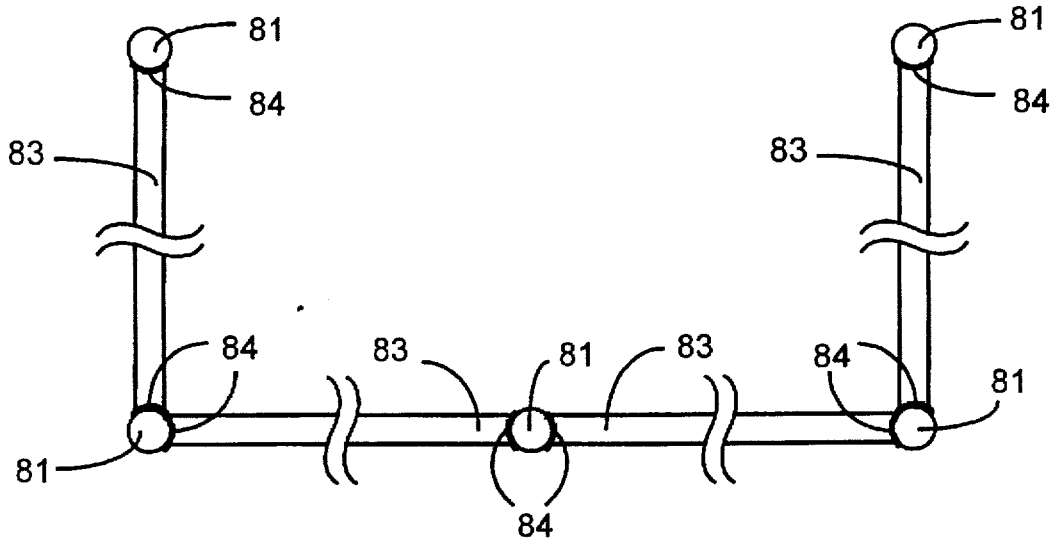
FIG. 4 is an end elevational view of a plurality of reinforcing bars welded together in a "U"-shaped pattern, to be used as an inner strengthening member.
Figure 5:
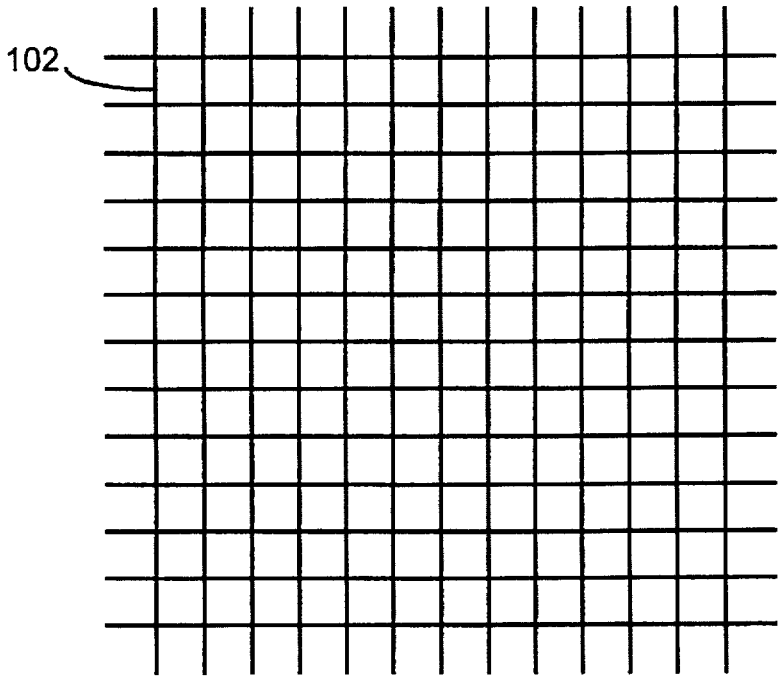
FIG. 5 is a top plan view of a metal mesh inner strengthening member.
Figure 6A:
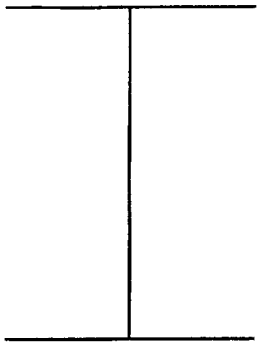
FIGS. 6A through 6F are end elevational views of various types of cross-sections of inner strengthening members.
Figure 6B:
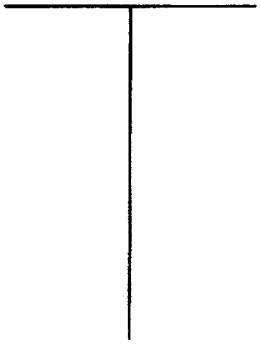
Figure 6C:
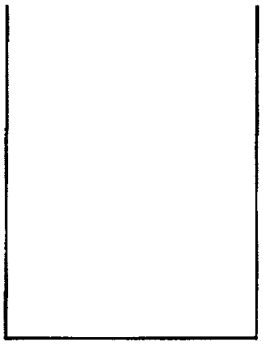
Figure 6D:
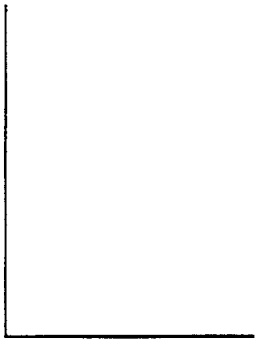
Figure 6E:
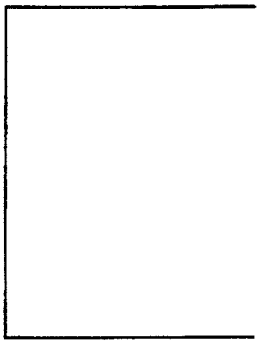
Figure 6F:
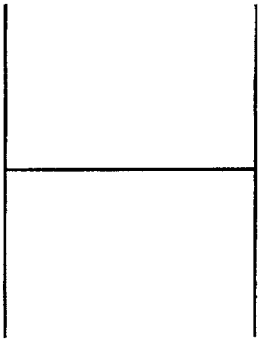
Figure 7:
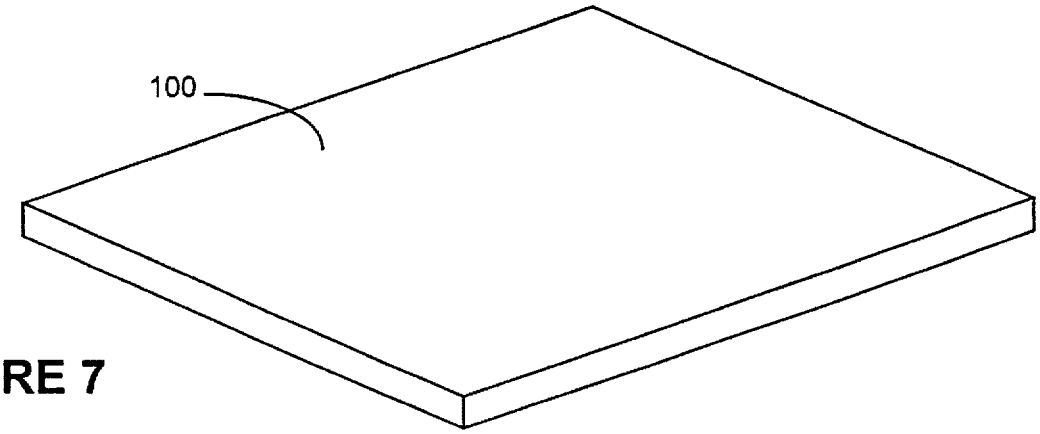
FIG. 7 is a perspective view of another embodiment of the composite load bearing structure according to the present invention, specifically a surfacing slab.

Reference will now be made to FIGS. 1 through 7, which show two embodiments of the composite load bearing structure, specifically, a railway tie in FIGS. 1, 2, and 3A to 3C, and a surface slab in FIG. 7, with various inner strengthening members shown in FIGS. 4, 5, and 6.

Referring now to FIGS. 1 and 2, a composite load bearing structure of the present invention in the form of a composite railway tie 20 is shown installed in a railway track 22, and supporting two rails 24 and 26. A representative portion of ballast 28 is also shown. The composite railway tie 20 comprises a main body portion 30 having a first longitudinal axis "A", a top surface 32 and a bottom surface 34 defining a dimension of thickness therebetween, a first side surface 36 and a second side surface 38 a dimension of width therebetween, and a first-end-facing surface 40 and a second-end-facing surface 42 defining a dimension of length therebetween. The dimension of thickness is significantly less than the length of the railway tie 20. Further, the width is also significantly less than the length of the railway tie 20. In the preferred embodiment, the top and bottom surfaces 32 and 34 are generally parallel one with the other; the first and second side surfaces 36 and 38 are also parallel one with the other, but also may be oriented or shaped otherwise, as will be discussed in greater detail subsequently, so as to preclude movement of the composite railway tie 20 in the direction of the first longitudinal axis "A" within the ballast. Further, the first and second end surfaces 40 and 42 are substantially parallel one to the other and substantially perpendicular to the top and bottom surfaces 32 and 34 and the first and second side surfaces 36 and 38, but also may be of an irregular shape or may be sloped.

The main body portion 30 of the first composite railway tie 20 is made of a first composite material, comprising a binding constituent in a proportion of about 10% to about 20% by volume and an aggregate material in a proportion of about 80% to about 90% by volume, with the two constituents adding up to 100%. The binding constituent in the main body portion 30 comprises a plastic material that is preferably polyethylene or a polyethylene blend having at least 10% polyethylene. The plastic material may be substantially exclusively, or at least mostly, recycled polyethylene—typically, polyethylene that has been collected through municipal recycling programs—for environmental and economic reasons. Unfortunately, recycled plastic material may be such that post-consumer plastics can include several types of plastics and also impurities, thus causing a degree of uncertainty as to the material properties of the resulting composite plastic material. It has been found that using only recycled polyethylene tends to create a composite railway tie 20 that is of slightly lesser strength, and is certainly of a less predictable strength, than a composite railway tie 20 having the binding constituent of the first composite material being virgin polyethylene only. Therefore, the plastic material may be substantially exclusively, or at least mostly, virgin polyethylene so as to ensure that the strength properties of the material are predictable and, therefore, are sufficient. Indeed, it is preferred that there be at least 20% virgin polyethylene in the plastic material of the binding constituent of said first composite material. Also, using virgin polyethylene permits selection of color, which is generally difficult using recycled polyethylene.

The aggregate material in the first composite material is in the form of irregular multifaceted pieces 44 of rock or material having similar properties thereto. The aggregate material may be chosen from a group of materials consisting of crushed furnace slag, crushed gravel, crushed gravel, crushed limestone, crushed granite, crushed basil, and crushed trap rock, or may comprise mixtures thereof. It is highly preferable that the material is crushed so as to create the necessary irregular multi-faceted pieces 44 that are necessary to give the main body portion 30 of the composite railway tie 20 its strength. The irregular multi-faceted pieces 44 abut one against the other so as to transmit forces therebetween. The "sharp" irregular faces of these multi-faceted pieces 44 of aggregate material help preclude the individual pieces 44 of aggregate material from slipping and generally moving one with respect to the other so that forces that are not perpendicular to two contacting surfaces may still be transmitted from one piece of aggregate material to the next without undue slippage.

The pieces 44 of aggregate material are distributed and otherwise arranged within the main body portion 30 so that opposed pieces 44 of the aggregate material have at least partial contact, one with another in a contiguous manner, so as to, in essence, provide a generally continuous force transmitting structure of high strength within the main body portion 30 of the composite railway tie 20. The aggregate material forms a force transmitting and, therefore, load bearing structure throughout the main body portion. The polyethylene plastic material binds the aggregate material together in this above stated arrangement so as to maintain its force transmitting characteristics and therefore maintain its overall structural strength.

It is important that the pieces 44 of aggregate material are of a size generally less than about 1.27 cm—or, in other words, all of the pieces of aggregate would pass through a screen having aperture size of 1.27 cm—and are larger than about 0.32 cm—or, in other words, the pieces of aggregate are shaped and dimensioned so as not to be passable through a 0.32 cm screen. It is important that the pieces 44 of aggregate material not be too large so as to avoid large gaps between the pieces of material, which large gaps would be filled with plastic material and thus be relatively weak and relatively soft and compressible. The composite railway tie 20 of the present invention might tend to fail at such a gap. It is highly desirable to keep the size of the pieces 44 of aggregate material above about 0.32 cm so as to preclude any fine material, such as sand, from being included therein. The inclusion of sand could potentially substantially weaken the composite railway tie 20. It has been found that, in order to have a relatively fully distribution of aggregate throughout the first composite material, the pieces 44 of the aggregate material should be distributed in size such that about 100% of the pieces 44 are shaped and dimensioned so as to be passable through a 1.27 cm screen, about 30% of the pieces 44 are shaped and dimensioned so as to be passable through a 0.93 cm screen, about 2% of the pieces 44 are shaped and dimensioned so as to be passable through a 0.63 cm screen, and substantially none of the pieces 44 are shaped and dimensioned so as to be passable through a 0.32 cm screen. Such a distribution ensures that all of the pieces 44 of aggregate material are generally less than about 1.27 cm in size and are greater than about 0.32 cm in size, and are also distributed in size so as to preclude any relatively large voids between the pieces 44 of aggregate material when in place in the first composite material.

As can be seen in FIGS. 3A through 3C, in order to fasten the rails 24 and 26 to the composite railway tie 20 of the present invention, it is possible to use various types of fastening means. One such type of fastening means, as shown in FIG. 2A, is in the form of large threaded coach bolts 53 with the fastener receiving apertures 54 for receiving such coach bolts 53, being co-operatively threaded. Preferably, a receiving plate 64 is retained in place by the threaded coach bolts 53. Extension portions 67 have apertures 68 therein, which apertures 68 are shaped and dimensioned to securely receive conventional "C" clips or "E" clips therein. Further, the fastener receiving element could be in the form of a conventional Pandrol type fastener 60, as shown in FIG. 2B, which eyelet type fastener 60 is shaped and dimensioned to receive a conventional "C" clip 62 or a conventional "E" clip (not shown) within apertures 61 and engage the base flanges of the rails 24 and 26 of the railroad track 28. Such Pandrol type fasteners and "C" clips and "E" clips are manufactured by Pandrol Inc., of Bridgeport, N.J., U.S.A. It is also possible, as shown in FIG. 2C, to have the fastener receiving apertures 55 disposed within a corresponding fastener receiving element 56, and with each fastener receiving element 56 being securely retained within the main body portion 30 of the composite railway tie 20 so as to dispose the fastener receiving aperture 55 at the exterior of the composite railway tie 20. Each fastener receiving aperture 55 is internally threaded so as to receive a co-operating threaded coach bolt (not shown). The fastener receiving elements 56 have a plurality of angled steps 57 at the exterior thereof to preclude the fastener receiving element 56 from being removed from the composite railway tie 20.

The composite railway tie 20 of the present invention further comprises at least one inner strengthening member 80 having a second longitudinal axis "B". As shown in FIGS. 1 and 2, there is only one elongate inner strengthening member 80, although there could be more than one, as is shown in FIG. 4, and as will be described in greater detail subsequently. The one inner strengthening member 80 is oriented such that the second longitudinal axis "B" thereof is substantially parallel to the first longitudinal axis "A" of the main body portion. Further, the inner strengthening member 80 is preferably just slightly shorter in length than the main body portion 30 of the composite railway tie so as to extend nearly the length of the main body portion 30 of the composite railway tie 20, but also to be completely covered by the main body portion 30 at its first and second end surfaces 40 and 42.

The inner strengthening member 80 is elongate and is made from a second material chosen from the group consisting of thermal plastic material, various metals, especially ferrous metals such as stainless steel or high carbon steel, carbon based fibre material, bound glass fibre material, composite alloy material, and mixtures thereof, where appropriate. The purpose of the inner strengthening member 80 is to increase the load bearing strength of the railway tie 20, largely by increasing the tensile strength of the bottom portion of the composite railway tie 20. Preferably, the main body portion 30 comprises from about 70% to about 90% of the total volume of the composite railway tie 20, and the at least one inner strengthening member 80 comprises from about 10% to about 30% of the total volume of the composite railway tie 20. The inner strengthening member 80 may be in the form of an "I" beam in cross-section, as shown in FIGS. 2 and 6A, or may be in the form of a modified "I" beam in cross-section (not shown), where the top flange of the modified "I" beam is narrower than the bottom flange thereof so as to permit fastening means, such as a bolt entered from the top surface 32 of the railway tie 20, to pass by the top flange and still enter into the bottom flange. The inner strengthening member 80 may also be an inverted "T" in shape (FIG. 6B) as the flange at the bottom would withstand tensile forces. The inner strengthening member may also have a cross-section in the shape of one of a "U" (FIG. 6C), an "L" (FIG. 6D), a "C" (FIG. 6E), or an "H" (FIG. 6F).

The inner strengthening member 80 may be in any one of a variety of forms, and may be made from any one of a variety of materials. As can be seen in FIG. 4, the inner strengthening member may comprise a reinforcing bar 81 made of a metal material, specifically a ferrous metal material. In this case, the reinforcing bar 81 would be fully recessed in the main body portion 30 so as to be completely covered by the first composite material such that the first composite material forms a substantially waterproof barrier around the reinforcing bar 81. As is apparent from FIG. 4, it is also possible to have a plurality of inner strengthening members structurally joined one to the other, by cross-members 83 welded to the reinforcing bars 81 by weld material 84. The five ferrous metal reinforcing bars 81 shown in FIG. 4, are arranged such that two of the five ferrous metal reinforcing bars 81 are adjacent the top surface 32 of the main body portion 30 and three of the five ferrous metal reinforcing bars 81 are adjacent the bottom surface 34 of the main body portion 30. Together, the five ferrous metal reinforcing bars 81 are disposed substantially in a "U"-shaped pattern so as to provide greater tensile strength at the bottom portion of the main body portion 30.

The inner strengthening members 80 may also be rolled, drawn, or cast ferrous sections, or rolled, drawn, or cast composite alloy sections, as required.

The inner strengthening members 80 may also be made from a thermoplastic material such as polyethylene. In this case, a portion of the plastic material of the binding constituent of the first composite material would become heat and pressure bonded with the plastic material in the second material of the inner strengthening member 80, so as to form a securely interlocked structural interface between the first composite material and the second material, to thereby form a single integral structure.

In any event, the manufacture of any of the load bearing structural elements of the present invention may be carried out in keeping with the teachings of co-pending application Ser. No. 08-368,903, noted above, the entirety of which is incorporated herein by reference.

The composite load bearing structure of the present invention, wherein the dimension of thickness is significantly less than the length of the load bearing structure and the dimension of width is also significantly less than the load bearing structure, such as in the railway tie 20 shown in FIGS. 1 and 2, may also take other forms such as a fence post or a pre-formed curb for use in parking lots.

Reference will now be made to FIG. 7, which shows a second embodiment of the composite load bearing structure of the present invention, specifically a surfacing slab 100. The surfacing slab 100 is an example of composite load bearing structures wherein the dimension of thickness is also significantly less than the dimension of width, in addition to being significantly less than the length of the load bearing structure. Typically, the length and the width of the load bearing structure are fairly close one to the other, and may be substantially the same or may be in a ratio of perhaps 2:1 or 3:1. The surfacing slab 100, as shown in FIG. 7, has a length and a width that are substantially similar, perhaps about two feet each, and a thickness of perhaps two inches. Other similar structures (not shown) each having a length and a width similar one to the other, and a thickness that is substantially less than the length and width, might include landscaping structural members, sound barriers, traffic barriers, and retaining wall members, among others. In any event, these composite load bearing structures are made from the same materials in the same proportions, and having at least one inner strengthening member, as appropriate, made from a suitable material, all as is discussed above with reference to FIGS. 1 through 6.

The surfacing slab 100 and other composite load bearing structures wherein the dimensions of thickness is significantly less than the dimensions of length and width, may have one or more inner strengthening members that follow the overall basic size and shape of the particular composite load bearing structure. As seen in FIG. 5, such an inner strengthening member 102 may be made from wire mesh or expanded metal mesh.

In an alternative embodiment, as can best be seen in FIG. 8, it is envisioned that the inner strengthening member 80' could comprise a thermoplastic material, such as polyethylene or a polyethylene blend, having monofilament fibre material 82 blended therein. Such monofilament fibre material 82 may be a glass fibre or carbon fibre material, or may be a more costly high strength material such as KEVLAR®. The addition of such a monofilament fibre material 82 into the second material of the inner strengthening member 80' provides for increased tensile strength of the inner strengthening member 80'. In the preferred embodiment, the monofilament fibre material in the main body portion 30 and in the inner strengthening member 80' are as long as possible, and may even be continuous along the entire length of the main body portion 30 and the inner strengthening member 80', as may be the case, so as to provide for maximum tensile strength.

In a further alternative embodiment of the composite railway tie 90 of the present invention, as shown in FIG. 9, it is envisioned that the first composite material of the main body portion 92 could comprise a binding constituent 94 in a proportion of about 10% to about 20% by volume, an aggregate material 96 in a proportion of about 80% to about 90% by volume, and strands of high tensile strength fibre material 98 in a proportion of about 0% to about 10% by volume. Such strands of high tensile strength fibre material 98 would increase the overall tensile strength of the main body portion 92 of the composite railway tie 90, and also would increase the stiffness of the composite railway tie 90 so as to preclude unwanted deflection that might occur during the support of extremely heavy loads. Such strands of high tensile strength fibre material might be a glass fibre material or a more costly material such as KEVLAR®. The same structure could, of course, be used such as a fence post, pre-formed curb, or traffic barrier.

It is apparent from the above description, the composite load bearing structure of the present invention, as illustrated by the composite railway tie 20 (FIGS. 1, 2 an 3A–3C) and the surfacing slab 100 (FIG. 7), is extremely strong and stable under repeated freezing and thawing conditions, will not chip or crack, and is resistant to moisture, oil, greases, and solvents.

It is also noted that a load bearing structural element in keeping with the present invention, especially when used as a railway tie, provides a structure which is electrically insulative, so as to permit electrical signals to be imposed on a pair of rails supported by the railway tie. There is no opportunity for water to intrude into the interior of the structure, and thus set up a conductive path along the length of the tie.

Other modifications and alterations may be used in the design and manufacture of the apparatus of the present invention without departing from the spirit and scope of the accompanying claims.

What is claimed is:

1. A composite load bearing structure comprising:

a main body portion having a top surface and a bottom surface defining a dimension of thickness therebetween, first and second-side surfaces defining a dimension of width therebetween, first and second end surfaces defining a dimension of length therebetween, and a first longitudinal axis oriented along the length of said main body portion;

wherein said dimension of thickness is significantly less than at least said length of said load bearing structure;

wherein said main body portion is made of a first composite material comprising a binding constituent in a proportion of about 10% to about 20% by volume, and an aggregate material in a proportion of about 80% to about 90% by volume;

wherein said binding constituent in said main body portion comprises a plastic material chosen from the group consisting of polyethylene and a polyethylene blend having at least 10% polyethylene;

wherein said aggregate material is in the form of irregular multi-faceted pieces chosen from the group consisting of crushed furnace slag, crushed gravel, crushed limestone, crushed granite, crushed basalt, crushed trap rock, and mixtures thereof; and wherein the pieces of said aggregate material are distributed and otherwise arranged within said main body portion so that opposed surfaces of said pieces of aggregate material have at least partial contact, one with another, in a contiguous manner; and at least one inner strengthening member having a second longitudinal axis which is substantially parallel to said first longitudinal axis;

wherein said at least one inner strengthening member is chosen from the group consisting of reinforcing bars; rolled, drawn, or cast ferrous sections; rolled, drawn, or cast composite alloy sections; plastic, metallic, and carbon based fibers; wire mesh, and expanded metal mesh.

2. The composite load bearing structure of claim 1, wherein said composite load bearing structure comprises a railway tie and said at least on inner strengthening member is elongate and made from a metal material.

3. The composite load bearing structure of claim 2, wherein said at least one inner strengthening member is fully recessed in said main body portion so as to be completely covered by said first composite material such that said first composite material forms a substantially waterproof barrier around said at least one inner strengthening member.

4. The composite load bearing structure of claim 3, wherein said at least one inner strengthening member is made from a ferrous metal material.

5. The composite load bearing structure of claim 4, wherein said at least one inner strengthening member comprises a plurality of inner strengthening members that are structurally joined one to another by welding.

6. The composite load bearing structure of claim 5, wherein said at least one metal inner strengthening member comprises reinforcing bar.

7. The composite load bearing structure of claim 6, wherein said plurality of inner strengthening members comprises two elongate inner strengthening members adjacent the top surface of said main body portion and three elongate inner strengthening members adjacent the bottom surface of said main body portion, together disposed substantially in a "U"-shaped pattern.

8. The composite load bearing structure of claim 4, wherein said at least one metal inner strengthening member is chosen from the group of high-carbon steel and stainless steel.

9. The composite load bearing structure of claim 8, wherein said at least one metal inner strengthening member has a cross-section in the shape of one of a "I", "T", "U", "L", "C", and "H".

10. The composite load bearing structure of claim 2, wherein said main body portion has at least one fastener receiving aperture therein, and wherein each said at least one fastener receiving aperture is adapted to receive and retain a fastening member therein for fastening the rails of a railroad track thereto.

11. The composite load bearing structure of claim 10, wherein each said at least one fastener receiving aperture is disposed within a corresponding fastener receiving element, and each fastener receiving element is securely retained within said main body portion of said composite load bearing structure so as to dispose said fastener receiving aperture at the exterior of said composite load bearing structure.

12. The composite load bearing structure of claim 1, wherein said at least one inner strengthening member is made from a metal material fully recessed in said main body portion so as to be completely covered by said first composite material such that said first composite material forms a substantially waterproof barrier around said at least one inner strengthening member.

13. The composite load bearing structure of claim 12, wherein said at least one inner strengthening member is made from a ferrous metal material.

14. The composite load bearing structure of claim 13, wherein said at least one inner strengthening member comprises a plurality of inner strengthening members that are structurally joined one to another by welding.

15. The composite load bearing structure of claim 1, wherein said dimension of thickness is also significantly less than said width of said load bearing structure.

16. The composite load bearing structure of claim 1, wherein said load bearing structure is chosen from the group of load bearing structures consisting of landscaping structural members, sound barriers, traffic barriers, surfacing slabs, retaining wall members, fence posts, and preformed curbs.

17. The composite load bearing structure of claim 1, wherein said dimension of width is also significantly less than said length of said load bearing structure.

18. The composite load bearing structure of claim 1, wherein said plastic at least one inner strengthening member is reinforced with one of a glass fibre material, high strength monofilament fibre material and carbon based fiber.

19. The composite load bearing structure of claim 1, wherein said plastic material in said main body portion comprises substantially exclusively virgin polyethylene.

20. The composite load bearing structure of claim 1, wherein said plastic material in said main body portion comprises substantially exclusively recycled polyethylene.

21. The composite load bearing structure of claim 1, wherein said pieces of said aggregate material are distributed in size such that about 100% of said pieces are shaped and dimensioned so as to be passable through a 1.27 cm screen, about 30% of said pieces are shaped and dimensioned so as to be passable through a 0.93 cm screen, about 2.0% of said pieces are shaped and dimensioned so as to be passable through a 0.63 cm screen, and substantially none of said pieces are shaped and dimensioned so as to be passable through a 0.32 cm screen.

22. The composite load bearing structure of claim 1, wherein said main body portion comprises from about 99% to about 30% of the total volume of said composite load bearing structure, and said at least one inner strengthening member comprises from about 1% to about 30% of the total volume of said composite load bearing structure.

23. The composite load bearing structure of claim 1, further comprising strands of high tensile strength fibre material in a proportion of about 0% to about 10% by volume disposed throughout said first composite material of said main body portion.

* * * * *